US005920036A

United States Patent [19]

Egger

[11] Patent Number: 5,920,036

[45] Date of Patent: Jul. 6, 1999

[54] INSULATOR FOR RECTANGULAR FENCE POST OR RAIL

[76] Inventor: Mary E. Egger, 1454 N. 66, Springfield, Oreg. 97478

[21] Appl. No.: 09/012,137

[22] Filed: Jan. 22, 1998

[51] Int. Cl.[6] ..... H01B 17/16

[52] U.S. Cl. ..... 174/161 F; 256/42; 248/74.2

[58] Field of Search ..... 174/171, 168, 174/154, 161 F, 163 F, 158 R, 158 F, 166 R, 161 R, 160; 256/10, 50, 53, 48, 47, 42; 248/71, 72, 74.1, 74.2, 63

[56] References Cited

U.S. PATENT DOCUMENTS

| | | | |
|---|---|---|---|
| D. 243,343 | 2/1977 | Berg, Jr. et al. . | |
| 2,222,249 | 11/1940 | Borgen | 256/48 |
| 2,437,344 | 3/1948 | Behlmann | 174/163 F |
| 2,865,609 | 12/1958 | Steiner | 256/10 |
| 2,996,285 | 8/1961 | Johnson | 256/47 |
| 3,250,517 | 5/1966 | Bramley . | |
| 3,572,639 | 3/1971 | Shettel | 256/10 |
| 3,654,383 | 4/1972 | Wilson . | |
| 3,689,686 | 9/1972 | Wilson . | |
| 3,733,429 | 5/1973 | Berg, Jr. et al. . | |
| 3,752,902 | 8/1973 | Wilson . | |
| 3,759,490 | 9/1973 | Heuberger . | |
| 3,896,596 | 7/1975 | Berger | 52/153 |
| 3,908,964 | 9/1975 | Leiblich . | |
| 4,061,873 | 12/1977 | Berg, Jr. et al. . | |
| 4,150,814 | 4/1979 | Warren et al. . | |
| 4,355,201 | 10/1982 | Wilson, Sr. . | |
| 4,531,019 | 7/1985 | Foissner et al. . | |
| 4,580,767 | 4/1986 | Zimmerman . | |
| 4,866,218 | 9/1989 | Wilson, Jr. . | |
| 4,883,923 | 11/1989 | Langlie et al. . | |
| 4,905,968 | 3/1990 | Eby et al. . | |
| 4,965,413 | 10/1990 | Langlie et al. . | |
| 4,982,932 | 1/1991 | Baker . | |
| 5,032,693 | 7/1991 | Langlie et al. . | |
| 5,063,274 | 11/1991 | Johnson . | |

*Primary Examiner*—Kristine Kincaid
*Assistant Examiner*—Dhiru R. Patel
*Attorney, Agent, or Firm*—Chase & Yakimo, L.C.

[57] ABSTRACT

An insulator is provided for supporting an electric wire or ribbon associated with an electric fence, including a pair of brackets that may be positioned about any location or elevation on a rectangular fence post or rail and then snappably secured thereto. The all plastic insulator is thus mounted without penetrating the post or rail with any hardware such as nails, bolts or staples. This assembly also allows easy removal of an insulator without damaging the post. The bracket assembly is also adjustable to accommodate a plurality of rectangular post sizes. Rubberized pads inside the bracket assembly provide friction and grip to more securely maintain the desired position. The bracket assembly integrally includes an elongated insulator body having a wire support holder attached thereto for easily receiving an electric wire or ribbon while substantially preventing accidental removal of the same.

20 Claims, 9 Drawing Sheets

INSULATOR FOR RECTANGULAR FENCE POST OR RAIL

BACKGROUND OF THE INVENTION

The present invention relates to an electric fence insulator and, more particularly, an insulator capable of attachment to a rectangular fence post or rail by simply snapping together a pair of brackets.

Various devices for mounting insulators to fence posts are known in the prior art and operate to support an electric fence wire or ribbon.

Although assumably effective in operation, the known devices for mounting insulators exhibit several disadvantages. Some known devices are only mountable to or around the top of a fence post or are incapable of being mounted at any desired elevation along the fence or fence post. Further, devices which are mounted using nails, bolts, or staples are undesirable because they are not easily removable or adjustable. Nail or like-mounted insulators are also destructive to the increasingly popular molded plastic fence posts and rails. Finally, existing insulator mounting devices are generally designed for round or T-shaped posts and do not efficiently accommodate rectangular posts and rails. Thus, it is desirable to have an insulator for holding a wire or ribbon for an electric fence that is easily mountable and adjustable at any position on rectangular fence posts or rails of various sizes.

SUMMARY OF THE INVENTION

Accordingly, it is a primary object of this invention to provide an insulator which may be mounted on a rectangular fence post or rail for supporting an electrically charged wire or ribbon.

Another object of this invention is to provide an insulator, as aforesaid, which may be mounted without the aid of any penetrating hardware such as nails, bolts, or staples.

Yet another object of this invention is to provide an insulator, as aforesaid, which may be mounted at any desired position or elevation on a rectangular fence post or rail.

A further object of this invention is to provide an insulator, as aforesaid, which is adjustable to accommodate a plurality of rectangular post sizes.

A still further object of this invention is to provide an insulator, as aforesaid, having rubberized pads within the mounting means that provide friction and grip to securely hold a mounted insulator in place.

A still further object of this invention is to provide an insulator, as aforesaid, which is easily mounted, adjusted or removed without damaging the fence post or rail.

A particular object of this invention is to provide an insulator, as aforesaid, that is simple and inexpensive to produce and that is aesthetically pleasing in appearance.

Other objects and advantages of this invention will become apparent from the following description taken in connection with the accompanying drawings, wherein is set forth by way of illustration and example, embodiments of this invention.

These objects are attained by providing an insulator which mounts to a rectangular fence post or rail without penetrating the post or rail with any other hardware such as nails, bolts, or staples. The insulator utilizes a pair of brackets that can be positioned about any location on a rectangular fence post or rail and then snappably secured thereto. The bracket assembly is snappably adjustable to accommodate a plurality of rectangular post or rail sizes and to facilitate simple and non-destructive removal of an insulator. The need for additional hardware or assembly is further eliminated by the insulator body and electric wire support member being integrally attached to one bracket.

DESCRIPTION OF THE PREFERRED EMBODIMENT

Figure 1:
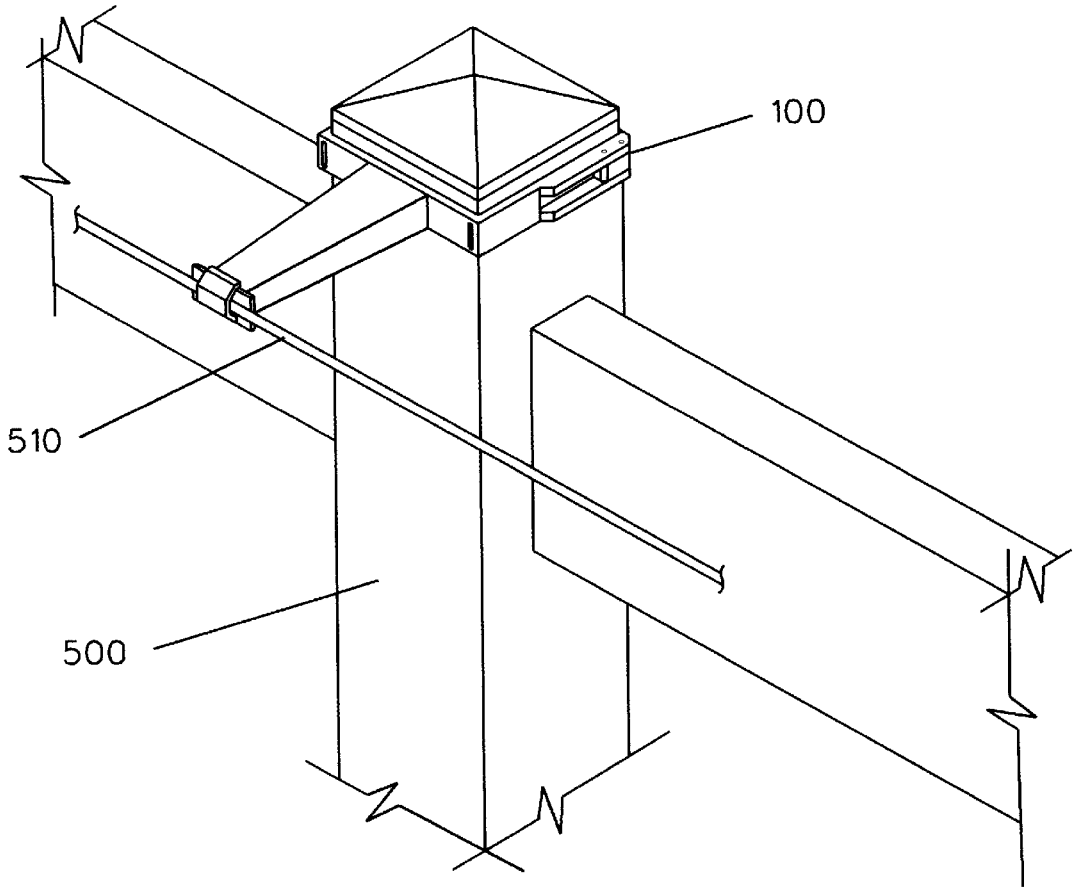
FIG. 1 is an isometric view of the insulator attached to a fence post.
Figure 2:
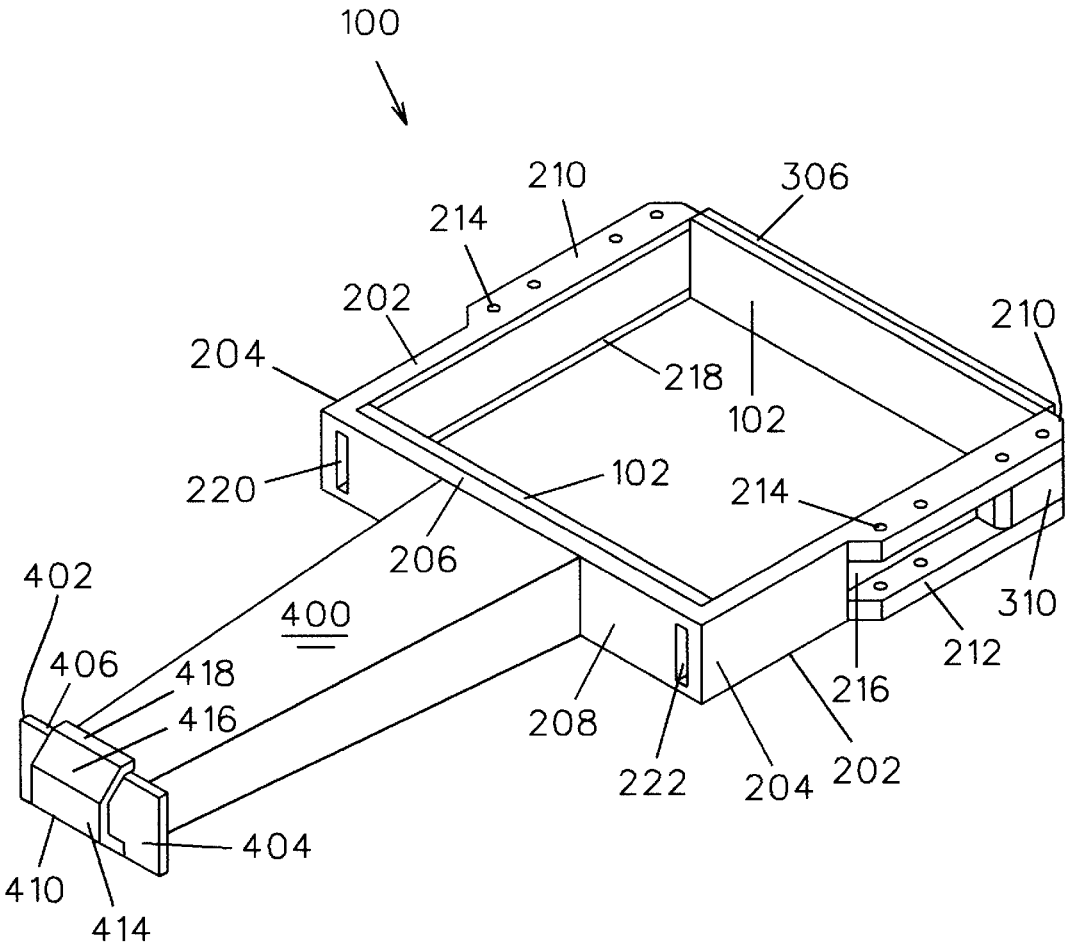
FIG. 2 is an isometric view of the insulator with first and second brackets snappably connected.
Figure 3:
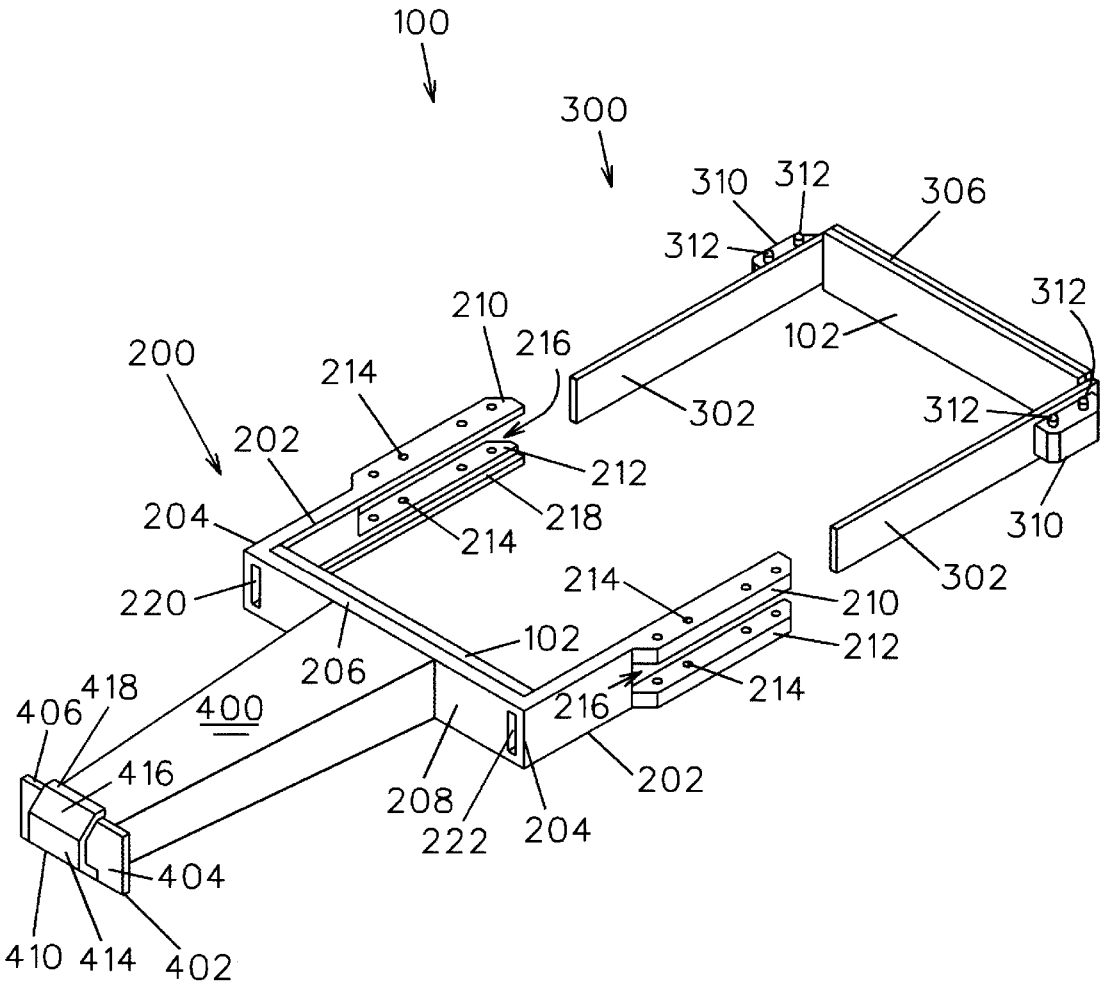
FIG. 3 is an isometric view of the insulator with first and second brackets disconnected.
Figure 4:
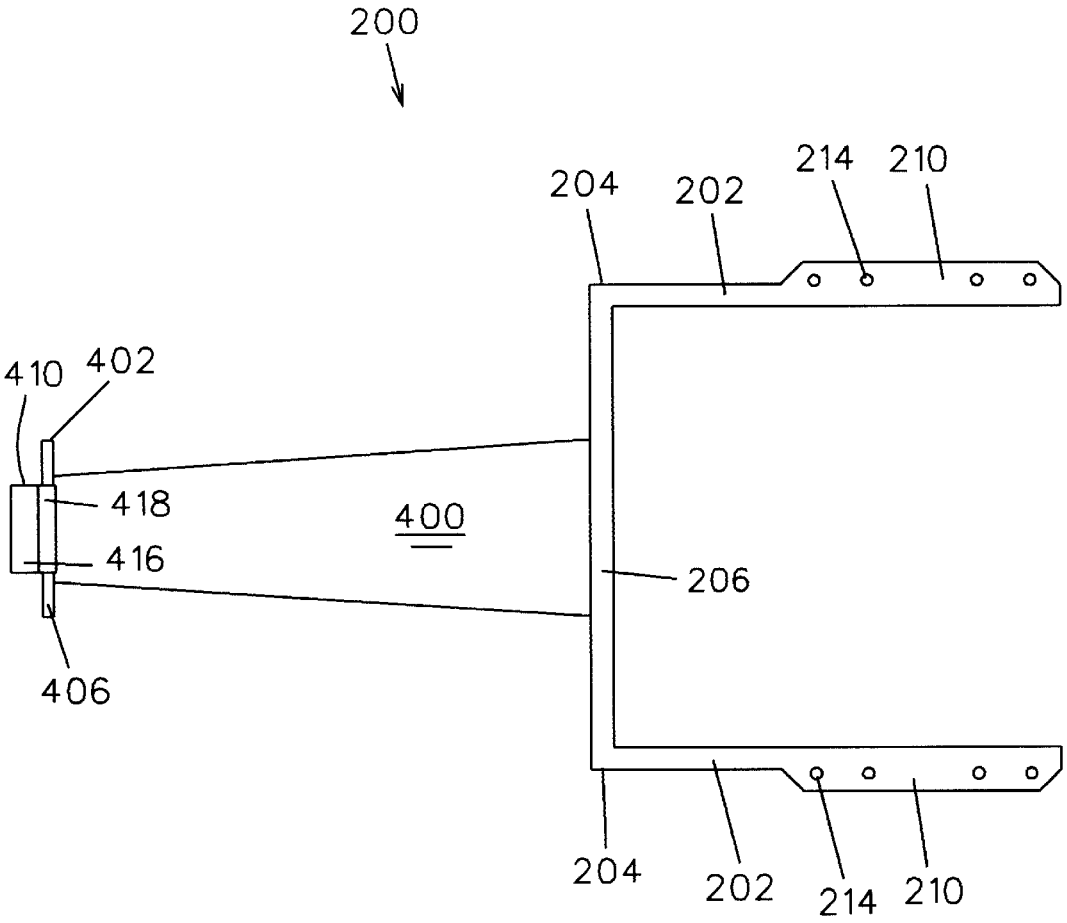
FIG. 4 is a top view of a first bracket of the insulator.
Figure 5:
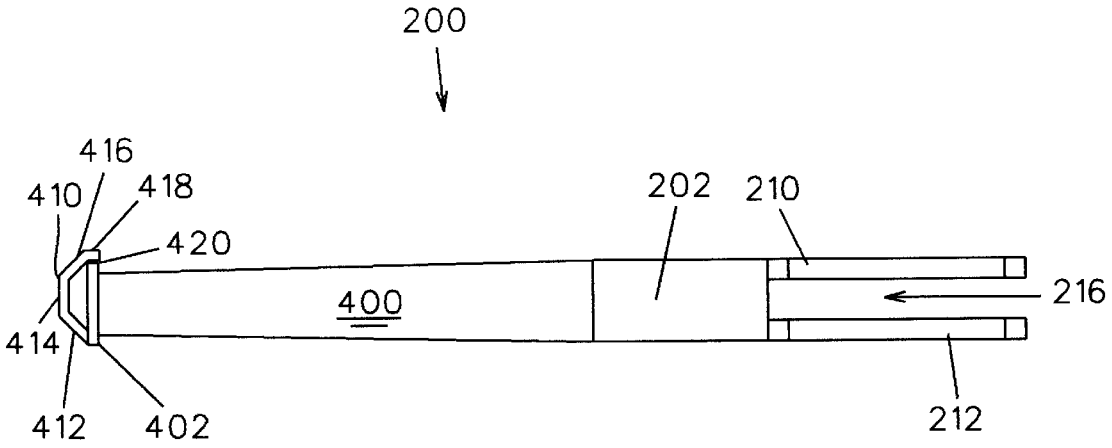
FIG. 5 is a side view of the first bracket.
Figure 6:
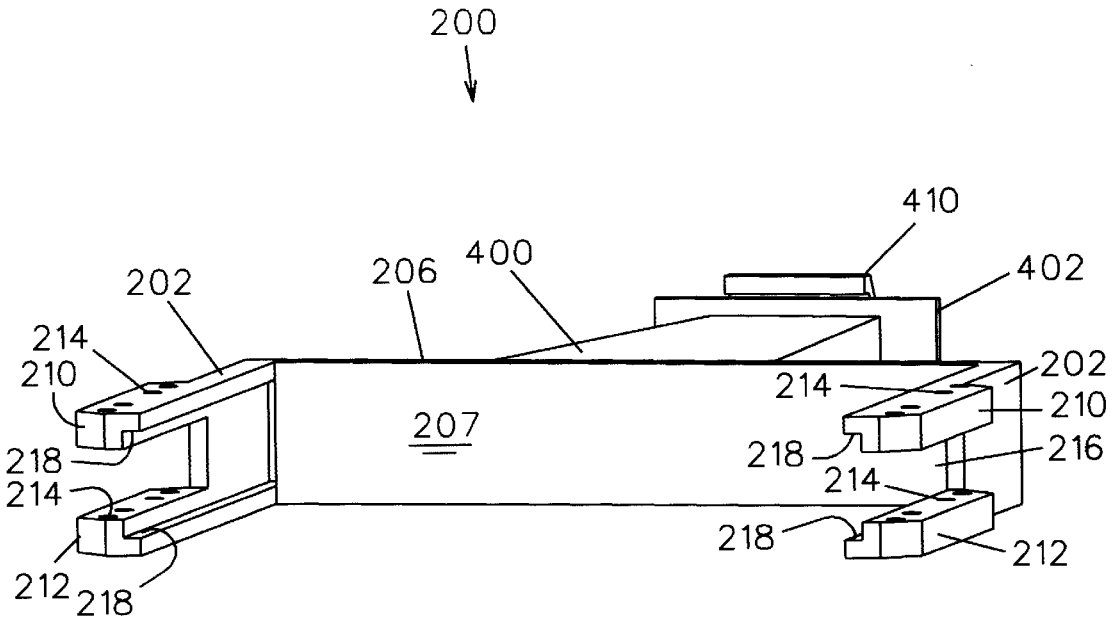
FIG. 6 is a rear perspective view of the first bracket.

Turning more particularly to the drawings, FIGS. 1–3 show the preferred embodiment of the insulator 100 having a first 200 and second bracket 300 for attachment about a rectangular fence post 500 or rail. The insulator 100 is preferably constructed entirely of a synthetic plastic with the exception of the rubberized pads 102. As illustrated in FIGS. 1–6, a first bracket 200 comprises an identical pair of oppositely disposed parallel arms 202 integrally connected at proximal ends 204 to a front member/web 206 perpendicularly intermediate said arms 202.

An insulator body 400 having an elongated construction is integrally joined to a front side 208 of the front web 206, said insulator body 400 decreasing in both height and width while forwardly extending to integrally conjoin a vertically disposed plate 402. A wire support member 410 is integrally joined to a point near the bottom of a front side 404 of the plate 402, said wire support member 410 having a first panel 412 upwardly and outwardly extending from the plate 402 at a 45° angle to a second panel 414 parallel to the plate 402. A third panel 416 upwardly and inwardly extends from the second panel 414 at a 45° angle to a top panel 418 perpendicularly overlapping a top side 406 of the plate 402. It is understood that the top panel 418 is not attached to the top side 406 of the plate 402.

In function, a slit 420 is formed between the top panel 418 of the wire support member 410 and the top side 406 of the plate 402 through which an electrically charged wire 510 or ribbon may easily be inserted. The overlapping construction also provides for efficient retention of the electric wire or ribbon 510. It is further understood that the plate 402 and second panel 414 of the wire support member 410 are parallel to one another and thus cooperate to maintain proper alignment and support of an electrical wire or ribbon 510 passing therebetween.

Each arm 202 of the first bracket 200 includes upper 210 and lower 212 outwardly extending flanges, each flange 210, 212 having a plurality of linearly spaced annular holes 214 therethrough to which the second bracket 300 may be snappably secured. The second bracket will be further described later. Each hole 214 in an upper flange 210 is connected by an imaginary vertical axis with a hole 214 in a lower flange 212. It is understood that while the illustrated embodiment shows two pairs of holes 214 in each flange 210, 212, thus representing two fence post size adjustments, the insulator described herein may contain additional holes to accommodate other post sizes. A channel 216 is formed between the upper 210 and lower 212 flanges through which post housings 310 on the second bracket 300 may be slidably inserted, said post housings being further described later. The first bracket 200 further includes a groove 218 interiorly disposed on and spanning the length of each arm 202, said groove 218 providing a track for receiving the arms 302 of the second bracket 300 as described below. Slots 220, 222 are vertically disposed in the front member 206 to receive the arms 302 of the second bracket 300 therethrough when certain adjustments of the insulator are preferred.

Figure 7:
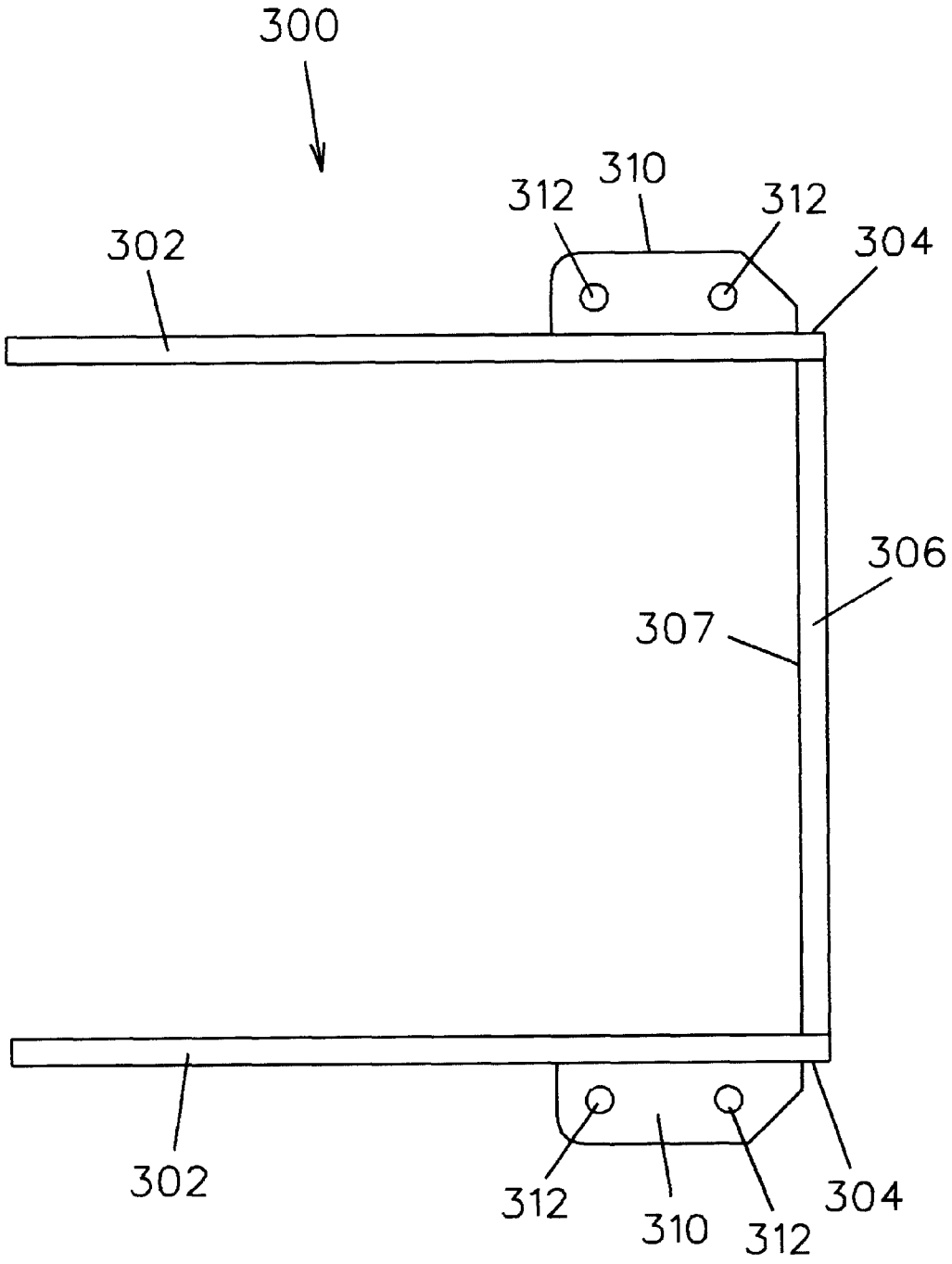
FIG. 7 is a top view of a second bracket of the insulator shown in FIG. 2.
Figure 8:
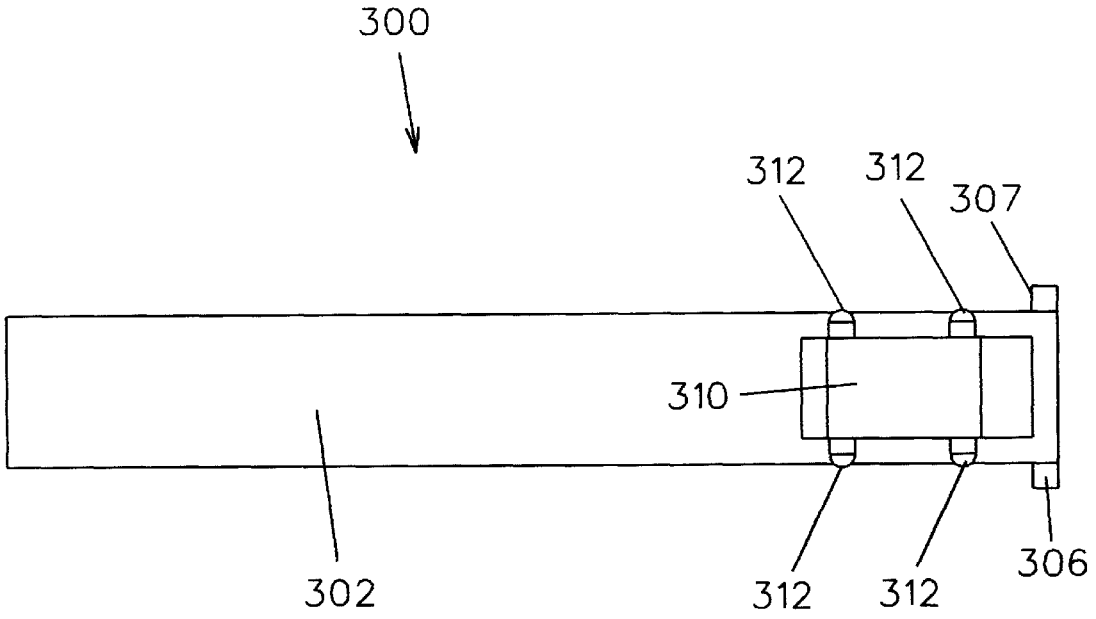
FIG. 8 is a side view of the second bracket.
Figure 9:
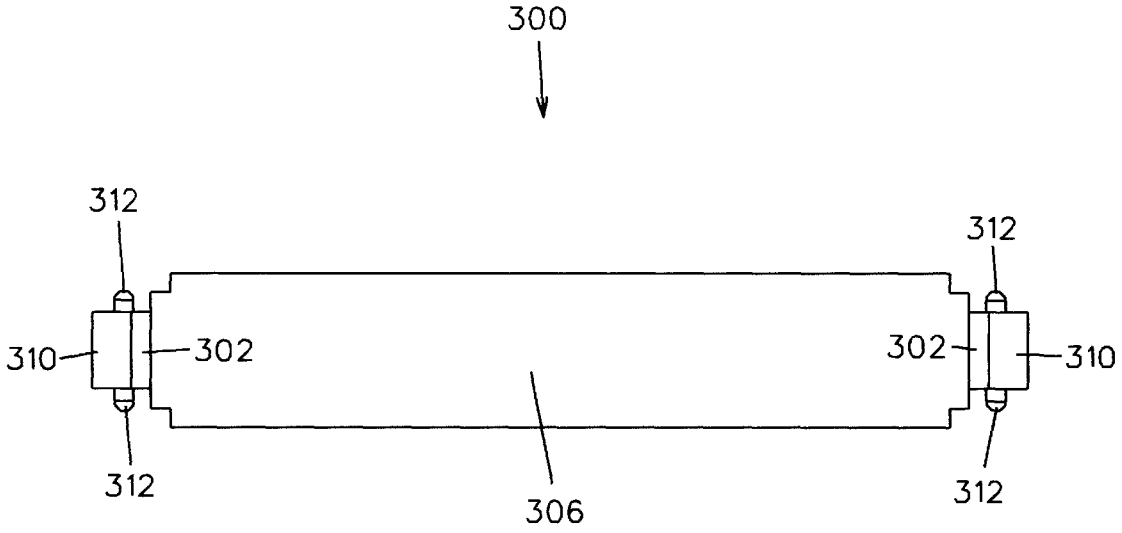
FIG. 9 is a rear view of the second bracket.

Turning to FIGS. 7–9, the second bracket 300 is now more specifically described. The second bracket 300 comprises an identical pair of oppositely disposed parallel arms 302 integrally connected at ends 304 to a back member/web 306 perpendicularly intermediate said arms 302. Each arm 302 of the second bracket 300 includes an exteriorly positioned post housing 310 having a pair of posts 312 extending upwardly and downwardly therefrom. The arms 302 of the second bracket 300 and the groove 218 formed in the arms 202 of the first bracket 200 are equal in height. Thus, the arms 302 of the second bracket 302 are slidably insertable into said groove 218 and through the slots 220, 222 in the front member 206 until the posts 312 are snappably secured in the desired holes 214 in the flanges 210, 212. It is understood that the flanges 210, 212 are sufficiently flexible to allow the posts 312 to slide freely through the channel 216 to the desired position before being secured.

Rubberized pads 102 may be fixedly attached to the interior sides 207, 307 of the front and back members 206, 306. Said rubberized pads 102 provide friction and grip to enhance maintenance of the positioning of an insulator 100 mounted on a smooth fence post or rail.

Accordingly, it can be seen that the insulator 100 is easily mountable or adjustable to any position on rectangular fence posts or rails of various sizes. In addition, the insulator requires no additional hardware for installation and is non-destructive to the fence post or rail.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An adaptor for supporting a wire from a fence post comprising:

a first bracket adapted to fit about a fence post, said bracket including:

first and a second spaced-apart arms with a web therebetween;

a flange having first and second ends, said first flange end attached to said first bracket web with said second flange end spaced therefrom;

means adapted for supporting a fence wire, said means attached to said second flange end;

a second bracket adapted to fit about the fence post, said second bracket including:

first and second spaced-apart arms with a web therebetween;

said second bracket arms adjustably secured to said arms of said first bracket encompassing said fence post.

2. The adaptor as claimed in claim 1 wherein said flange is an electrical insulator; and the wire is an electrically charged conductor.

3. The adaptor as claimed in claim 1 further comprising means for locking said first bracket to said second bracket, said locking means comprising:

a pair of upper and lower flanges extending outwardly from each of said arms of said first bracket;

a plurality of apertures on at least one of said upper or lower flanges of said pair of said flanges extending from said arms of said first bracket;

a pair of post housings having at least one post extending therefrom, said housings extending outwardly from said arms of said second bracket;

said housings slidably insertable between said upper and lower flanges;

said at least one post engaging one of said apertures for locking said brackets together in place.

4. The adaptor as claimed in claim 3 further comprising means for slidably engaging said first bracket with said second bracket, said engaging means comprising:

an inner surface on each of said arms of said first bracket;

a channel in each of said inner surfaces for accepting said second bracket arms;

said arms of said second bracket each having a free end;

a pair of slots in said web of said first bracket aligned with said channels of said first bracket arms to receive said free ends of said second bracket arms therethrough upon said acceptance of said second bracket arms in said channels.

5. The adaptor as claimed in claim 3 wherein said at least one post extends upwardly or downwardly from said post housings.

6. The adaptor as claimed in claim 3 wherein said pair of upper and lower flanges have a plurality of apertures.

7. The adaptor as claimed in claim 1 further comprising:

an inner surface on said web of said first bracket;

an inner surface on said web of said second bracket;

a first rubberized pad secured to said first bracket web inner surface;

a second rubberized pad secured to said second bracket web inner surface.

8. The adaptor as claimed in claim 1 further comprising:

means for slidably engaging said first bracket with said second bracket, said engaging means comprising:

an inner surface on each of said arms of said first bracket;

a channel in each of said inner surfaces for accepting said second bracket arms;

said arms of said second bracket each having a free end;

a pair of slots in said web of said first bracket aligned with said channels of said inner surfaces of said first bracket arms to receive said free ends of said second bracket arms therethrough upon said acceptance of said second bracket arms in said channels;

means for locking said first bracket to said second bracket, said locking means comprising:

a pair of upper and lower flanges having a plurality of apertures, said flanges extending outwardly from said arms of said first bracket;

a pair of post housings having at least one post extending upwardly and downwardly therefrom, said housings extending outwardly from said arms of said second bracket;

said post housings slidably insertable between said upper and lower flanges;

said at least one post engaging one of said apertures for locking said brackets together in place;

an inner surface on said web of said first bracket;

an inner surface on said web of said second bracket;

a first rubberized pad secured to said first bracket web inner surface;

a second rubberized pad secured to said second bracket web inner surface.

9. An adaptor for supporting a wire from a fence post comprising;

a first bracket adapted to fit about a fence post, said bracket comprising:

a pair of oppositely disposed parallel arms each arm having a fixed end and a free end, an upper and lower outwardly extending flanges, and an inner surface having at least one channel;

a plurality of apertures on at least one of said pairs of said flanges;

a front web secured to said first bracket arm fixed ends and perpendicularly intermediate said first bracket arms;

a flange having a first and second end, said first flange end secured to said first bracket web with said second end spaced therefrom;

means adapted for supporting a fence wire, said means attached to said second flange end;

a second bracket adapted to fit about the fence post, said bracket comprising:

a pair of oppositely disposed parallel arms each having a fixed end and a free end, and an outwardly extending post housing, said post housing having at least one post extending therefrom;

a back web secured to said second bracket arms fixed ends and perpendicularly intermediate said arms;

said second bracket arms free ends slidably insertable into said at least one first bracket channel, along said first bracket arms;

said at least one post of said second bracket snappably secured in one of said first bracket flange apertures.

10. The adaptor as claimed in claim 9 wherein said flange is an electrical insulator, and the fence wire is an electrically charged conductor.

11. The adaptor as claimed in claim 9 wherein said front web has a pair of slots aligned with said at least one channel in said first bracket arms, said slots seating said free ends of said second bracket arms therein.

12. The adaptor as claimed in claim 9 further comprising:

an inner surface on said front web;

an inner surface said back web;

a first rubberized pad secured to said front web inner surface;

a second rubberized pad secured to said back web inner surface.

13. The adaptor as claimed in claim 9 wherein said at least one post of said second bracket extends upwardly or downwardly from said post housing.

14. The combination as claimed in claim 9 wherein said pairs of upper and lower flanges have a plurality of apertures.

15. An adaptor for supporting a fence wire from a fence post comprising:

a first flexible bracket having a first arm section, a second arm section opposed said first arm section and a web section therebetween;

an elongated flange having a first end attached to said web section and a second end spaced therefrom;

means adapted for supporting a fence wire, said means attached to said second flange end;

a second flexible bracket having a first arm section and an opposed second arm section;

said first arm of said first bracket adjustably secured to said first arm of said second bracket;

said second arm of said first bracket adjustably secured to said second arm of said second bracket.

16. The adaptor as claimed in claim 15 wherein said elongated flange is an electrical insulator and the wire is an electrically charged conductor.

17. The adaptor as claimed in claim 15 further comprising means for securing said first bracket to said second bracket, said securing means comprising:

at least one pair of posts extending outwardly from said first and second arm sections of said first flexible bracket;

at least one pair of apertures in said first and second arm sections of said second flexible bracket;

said at least one pair of posts extending outwardly from said first arm section of said first flexible bracket snappably engaged with said at least one pair of apertures in said first arm section of said second flexible bracket therethrough;

said at least one pair of posts extending outwardly from said second arm section of said first flexible bracket snappably engaged with said at least one pair of apertures in said second arm section of said second flexible bracket therethrough.

18. The adaptor as claimed in claim 15 further comprising means for slidably engaging said first bracket with said second bracket, said engaging means comprising:

a first channel in said first arm section of said first flexible bracket;

a second channel in said second arm section of said first flexible bracket;

said first arm section of said second flexible bracket having a free end;

said second arm section of said second flexible bracket having a free end;

said first channel adapted to slidably receive said free end of said first arm section of said second flexible bracket therein;

said second channel adapted to slidably receive said free end of said second arm section of said second flexible bracket therein.

19. The combination as claimed in claim 15 further comprising:

an inner surface on said first flexible bracket;

an inner surface on said second flexible bracket;

a first rubberized pad secured to said first flexible bracket inner surface;

a second rubberized pad secured to said second flexible bracket inner surface.

20. The adaptor as claimed in claim 15 further comprising means for securing said first bracket to said second bracket comprising:

an outer surface on said first flexible bracket having at least one pair of posts extending outwardly from said first and second arm sections;

said first and second arm sections of said first flexible bracket each having a free end;

an inner surface on said second flexible bracket having a longitudinal channel extending along said first arm section and said second arm section of said second flexible bracket;

at least one pair of apertures in said first and second arm sections of said second flexible bracket;

said channel in said first arm section of said second flexible bracket adapted to slidably receive said free end of said first arm section of said first flexible bracket;

said at least one pair of posts extending outwardly from said first arm section of said first flexible bracket snappably engaged with said at least one pair of apertures in said first arm section of said second flexible bracket;

said channel in said second arm section of said second flexible bracket adapted to slidably receive said free end of said second arm section of said first flexible bracket;

said at least one pair of posts extending outwardly from said second arm section of said first flexible bracket snappably engaged with said at least one pair of apertures in said second arm section of said second flexible bracket, locking said first and second brackets together.

* * * * *